US005904435A

United States Patent [19]

Tung

[11] Patent Number: 5,904,435

[45] Date of Patent: May 18, 1999

[54] LOCKING BOOSTER RING BINDER MECHANISM

[75] Inventor: Vincent W. M. Tung, Kowloon, The Hong Kong Special Administrative Region of the People's Republic of China

[73] Assignee: Hong Kong Stationary Manufacturing Co., Ltd., Kowloon, The Hong Kong Special Administrative Region of the People's Republic of China

[21] Appl. No.: 08/919,616

[22] Filed: Aug. 28, 1997

[51] Int. Cl.[6] ..... B42F 13/16; B42F 3/04

[52] U.S. Cl. ..... 402/38; 402/37; 402/41

[58] Field of Search ..... 402/26, 38, 37, 402/39, 40, 41

[56] References Cited

U.S. PATENT DOCUMENTS

| | | |
|---|---|---|
| 3,884,586 | 5/1975 | Michaelis et al. . |
| 4,566,817 | 1/1986 | Barrett, Jr. . |
| 4,813,803 | 3/1989 | Gross . |
| 5,067,840 | 11/1991 | Cooper et al. . |
| 5,116,157 | 5/1992 | Gillum et al. . |
| 5,135,323 | 8/1992 | Pinheiro . |
| 5,180,247 | 1/1993 | Yu . |
| 5,255,991 | 10/1993 | Sparkes . |
| 5,354,142 | 10/1994 | Yu . |

*Primary Examiner*—Frances Han
*Assistant Examiner*—Alisa L. Thurston
*Attorney, Agent, or Firm*—Shoemaker and Mattare, Ltd

[57] ABSTRACT

A locking booster ring binder mechanism includes a pair of locking levers, each having a tongue which extends through an opening at one end of the leaves of the mechanism. The tongue has a head wider than the opening, so that the head presses up on the leaves to open the rings when the trigger is pressed outward and downward. A pair of legs extend from either side of the tongue along the sides of the opening between the leaves. The legs have blocking protuberances which bear against the sides of the opening, and prevent the leaves from being opened, when the lever is in a locked position, but not when the lever is in an unlocked position.

7 Claims, 4 Drawing Sheets

LOCKING BOOSTER RING BINDER MECHANISM

BACKGROUND OF THE INVENTION

This invention relates to the art of stationery supplies, and more particularly to a locking booster ring binder mechanism.

Most locking ring binder mechanisms have locking levers (sometimes just one) at either end of the device. The locking levers have a locking position, usually perpendicular to the shell, in which the rings cannot be opened by pulling on them. The purpose is primarily to prevent the rings from coming open unintentionally. Such devices, unfortunately, are not always reliable, and are prone to breakage.

SUMMARY OF THE INVENTION

An object of the invention is to provide a locking ring mechanism having more reliable performance.

Another object of the invention is to make a locking ring mechanism more resistant to breakage.

These and other objects are attained by a locking booster that includes a shell containing a pair of hinged leaves and a pair of locking levers, each having a tongue which extends through an opening at one end of the leaves of the mechanism. The tongue has a head wider than the opening, so that the head presses up on the leaves to open the rings when the trigger is pressed outward and downward, and a pair of legs extend from either side of the tongue along the sides of the opening between the leaves. The legs have blocking protuberances which bear against the sides of the opening, and prevent the leaves from being opened, when the lever is in a locked position, but not when the lever is in an unlocked position. The lever is more reliably secured at the end of the shell by providing the shell with tabs at its corners, and bending the tabs over the corners after crimping them.

BRIEF DESCRIPTION OF THE DRAWINGS

In the accompanying drawings.

DESCRIPTION OF THE PREFERRED EMBODIMENT

Figure 1:
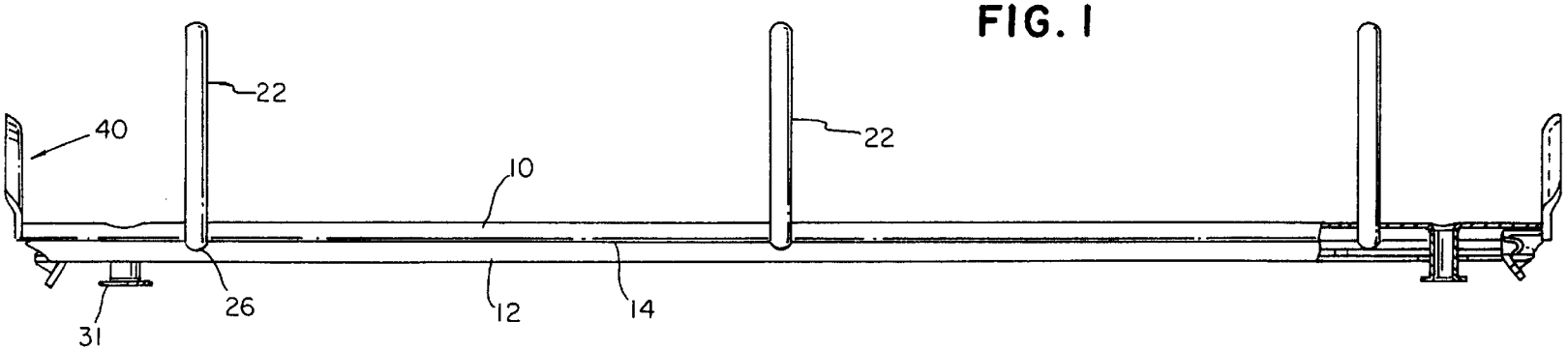
FIG. 1 is a side elevation of a locking booster ring binder mechanism embodying the invention, with the rings closed.
Figure 2:
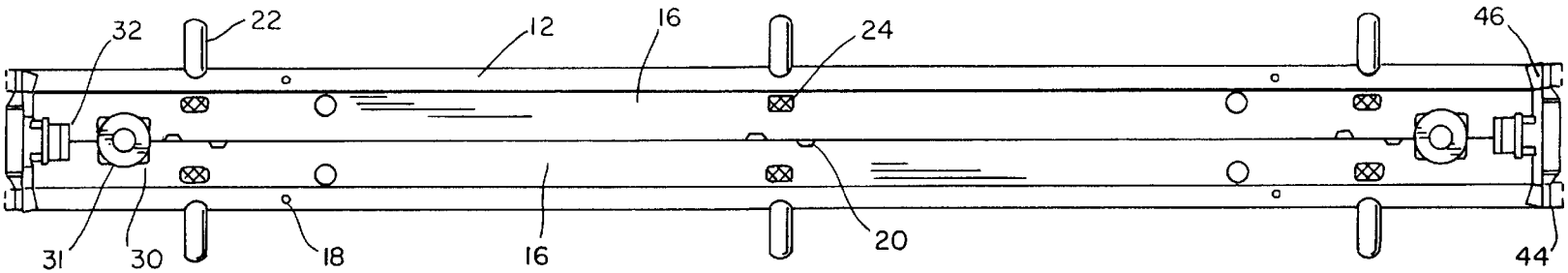
FIG. 2 is a bottom view thereof.
Figure 3:
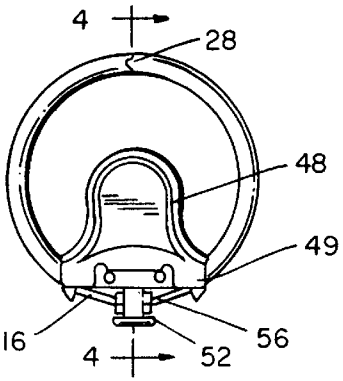
FIG. 3 is an end view thereof (the view from the opposite end being identical)
Figure 5:
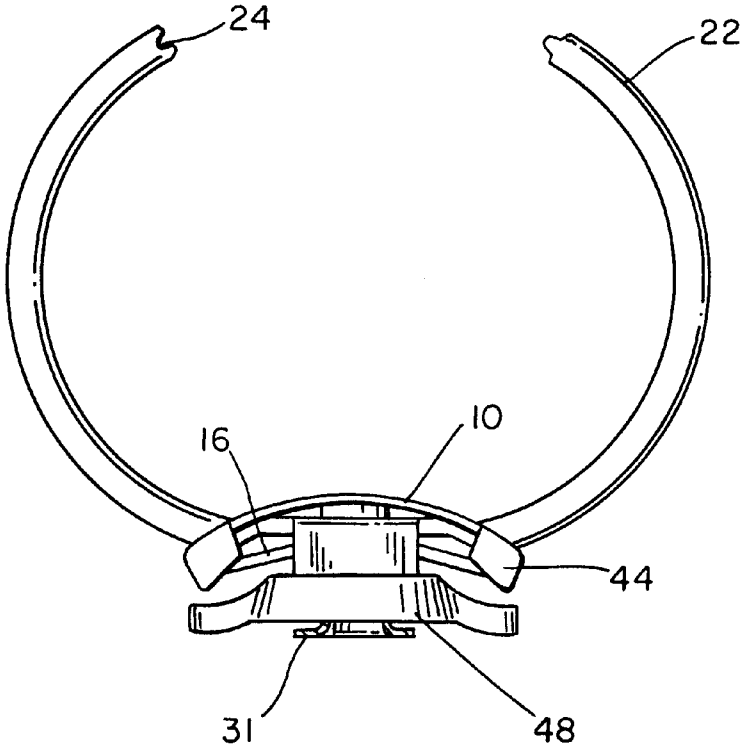
FIG. 5 is an enlarged end view, with the rings open.
Figure 4:
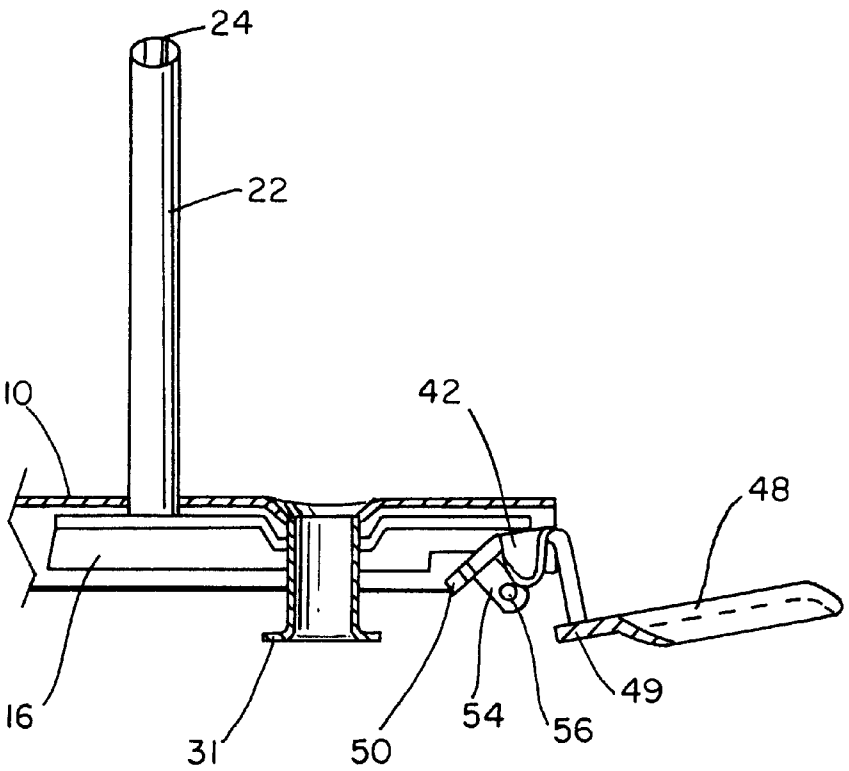
FIG. 4 is an enlarged sectional view of a portion of the mechanism, taken on the plane 4—4 in FIG. 3.

A locking booster ring binder mechanism embodying the invention is shown in FIGS. 1–3. It includes a resilient elongate shell 10, formed from sheet steel into a cylindrical arc to provide rigidity. The lateral edges 12 are bent inward, forming seats 14 for the outer edges of a pair of flat leaves 16. Four dimples 18 in the inwardly bent edges eliminate free play. The blades are about as long as the shell and are hinged together at their inner edges by small swaged fingers 20 which keep the inner edges aligned and in contact with one another. Half-rings 22 are secured in holes in the leaves by deforming the lower ends of the rings at 24. The rings halves extend upward from the leaves through slots 26 in the shell, and meet at their tips 28, which have nesting sinusoidal end surfaces. The total width of the leaves is slightly greater than the seat-to-seat distance, so that, as the leaves pass center (i.e., when they are coplanar), they flatten the shell slightly. The shell thus acts as a spring, forcing the leaves toward either an upwardly open or downwardly open broad "V" configuration. The lowermost position of the leaves is determined by contact between the ends of the ring halves; the upper limit is determined by contact between the leaves and the bottom of the shell, at its center.

One can from FIG. 2 that each leaf has four rectangular openings cut from its inner edge: two (30) which clear the mounting rivets 31, which are affixed to the spine of the binder, and two (32) which form a openings at the ends of the leaves.

Each locking lever 40 has a fulcrum axis defined by two arms 42 which extend laterally outward from the lever; the arms are retained within the seats, by crimping the ends of edges of the shell at the corners 44, and folding over the small tabs 46, as shown in FIG. 2, wherein the tabs prior to bending are indicated by broken lines.

The portion of the lever above the fulcrum axis is a broad, flat trigger 48 designed to be operated with the thumb. Two short tangs 49 at the bottom of the trigger cover the corners of the shell, to prevent injury.

The portion of the lever extending below the fulcrum point terminates at a tongue 50 having a "T" head 52. Two parallel legs 54, each extending from and bent perpendicular to the tongue, have small round protuberances 56 which extend outward, away from one another. The legs fit closely within the opening, keeping the locking lever centered.

Figure 6:
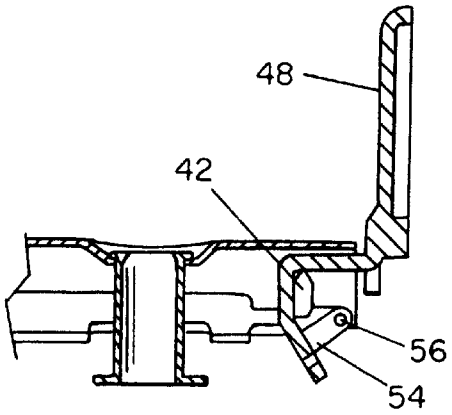
FIGS. 6–8 are simplified sectional views on the plane 4—4 in FIG. 3, showing a locking lever in closed, partially open, and fully open positions, respectively.

When the levers are in their locked position (FIG. 6), the rings cannot be opened directly. The locking of the rings results from interference between the protuberances and the lateral edges of the end slots on the leaves, which can be seen in FIG. 2.

Figure 7:
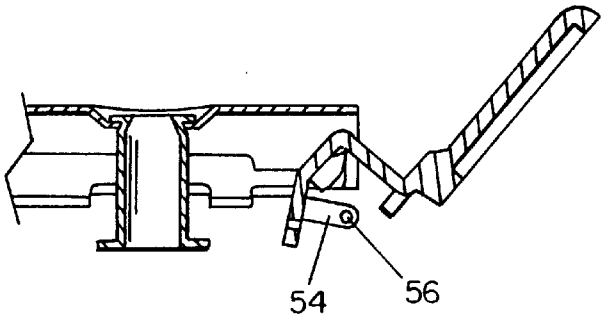

When the locking levers are moved to their intermediate position (FIG. 7), the protuberances are out of the way of the edges of the opening 30, and the rings may be opened by pulling on the rings.

Figure 8:
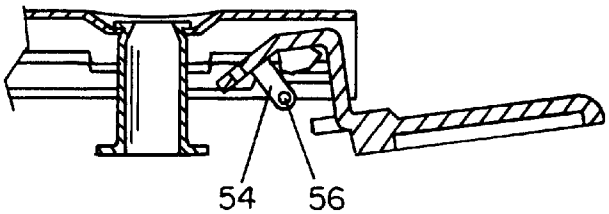
Figure 10:
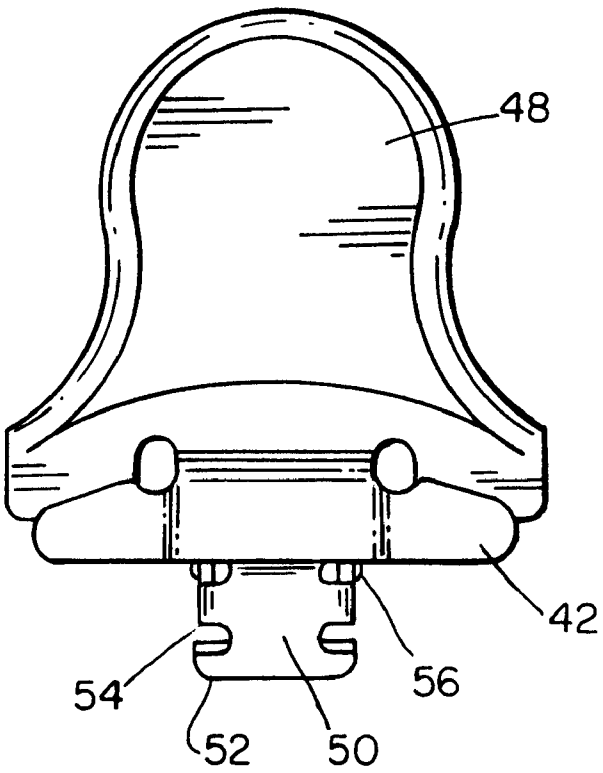
FIG. 10 is an end view thereof.
Figure 9:
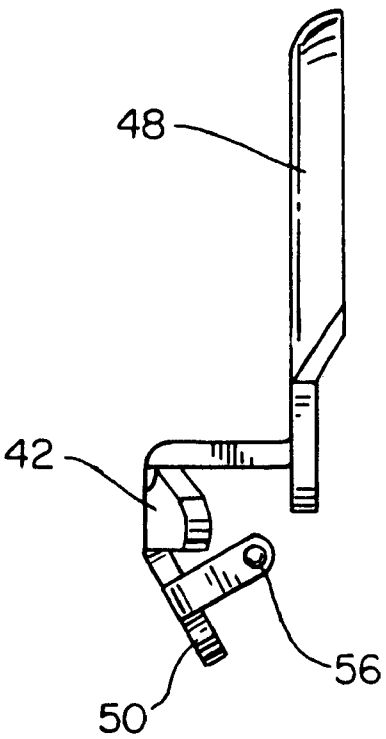
FIG. 9 is a side view of the locking lever alone.

If the levers are moved further still, with greater force, to their extreme downward position (FIG. 8), they force the rings open indirectly. The rings cannot be driven closed by manipulating the triggers, and they are never locked open.

While the best form of the invention presently contemplated has been described above, it should be evident that modifications of the described device are possible, and may prove better. The protuberances, for example, could take a variety of forms, and still function basically as described.

Since the invention is subject to variations, it is intended that the foregoing description and the accompanying drawings shall be interpreted as only illustrative of the invention defined by the following claims.

I claim:

1. In a locking ring binder mechanism comprising a resilient metal shell having lateral edges turned inward to form seats extending along the length of the shell, a pair of hinged leaves seated in the respective seats, plural pairs of ring halves affixed to the leaves and extending beyond the shell, the leaves having a combined width greater than the distance between the seats whereby the rings toggle between open and closed positions, and at least one locking lever, retained at an end of the shell, for controlling the movement of the leaves and rings, the leaves having opposed cutouts forming an opening, and the locking lever has a pair of arms serving as a fulcrum, a trigger extending away from the fulcrum in one direction, upon which finger pressure can be applied, and a tongue extending in the opposite direction from the fulcrum so as to interact with the opening in the blades, the improvement wherein the tongue extends through the opening and has a head wider than the opening, so that the head presses up on the leaves to open the rings when the trigger is pressed outward and downward, and a pair of legs extend from either side of the tongue along the sides of the opening in the leaves, the legs having blocking portions which bear against the sides of the opening, and prevent the leaves from being opened, when the lever is in a locked position, but not when the lever is in an unlocked position.

2. The invention of claim 1, wherein the blocking portions are protuberances extending away from one another, on either leg.

3. The invention of claim 2, wherein the protuberances are round dimples formed at the tips of the legs.

4. The invention of claim 3, wherein the lever is formed from sheet metal of uniform thickness.

5. The invention of claim 3, wherein the protuberances are aligned with the edges of the opening when the levers are in the locking positions, but not when the levers are in their unlocked positions.

6. In a locking booster ring binder mechanism comprising a resilient metal shell having lateral edges turned inward to form seats extending along the length of the shell, a pair of hinged leaves seated in the respective seats, and having a combined width greater than the distance between the seats, plural pairs of ring halves affixed to the leaves and extending beyond the shell, and at least one locking lever, retained at an end of the shell, for controlling the movement of the leaves and rings, the leaves have opposed cutouts forming an opening, and the locking lever has a pair of arms serving as a fulcrum, a trigger extending away from the fulcrum in one direction, upon which finger pressure can be applied, and a tongue extending in the opposite direction from the fulcrum so as to interact with the opening in the blades, the improvement wherein the shell is formed from a blank having tabs at each corner, extending lengthwise of the blank, and the arms on the lever are retained in the seats by crimping the lateral edges of the shell near the corners, and then bending the tabs downward around the crimped portions.

7. In a locking booster ring binder mechanism comprising a resilient metal shell having lateral edges turned inward to form seats extending along the length of the shell, a pair of hinged leaves seated in the respective seats, and having a combined width greater than the distance between the seats, plural pairs of ring halves affixed to the leaves and extending beyond the shell, and at least one locking lever, retained at an end of the shell, for controlling the movement of the leaves and rings, the leaves have opposed cutouts forming an opening, and the locking lever has a pair of arms serving as a fulcrum, a trigger extending away from the fulcrum in one direction, upon which finger pressure can be applied, and a tongue extending in the opposite direction from the fulcrum so as to interact with the opening in the blades, the improvement wherein the trigger has a pair of tangs normally covering the corners of the shell to prevent injury.

* * * * *

UNITED STATES PATENT AND TRADEMARK OFFICE

CERTIFICATE OF CORRECTION

PATENT NO. : 5,904,435
DATED : May 18, 1999
INVENTOR(S) : Vincent W.M. Tung

It is certified that error appears in the above-identified patent and that said Letters Patent is hereby corrected as shown below: On the title page: Item [73]

Assignee --HONG KONG STATIONERY MANUFACTURING CO., LTD.--

Signed and Sealed this
First Day of February, 2000

*Attest:*

*Attesting Officer*

Q. TODD DICKINSON

*Acting Commissioner of Patents and Trademarks*